US007533956B2

(12) United States Patent
Hatanaka et al.

(10) Patent No.: US 7,533,956 B2
(45) Date of Patent: May 19, 2009

(54) METHOD OF CONTROLLING LIQUID EJECTION FOR MARGINLESS PRINTING WITH WASTE LIQUID RECESS PORTION

(75) Inventors: Yuji Hatanaka, Nagano (JP); Hiroshi Shiohara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 492 days.

(21) Appl. No.: 11/357,491

(22) Filed: Feb. 17, 2006

(65) Prior Publication Data

US 2006/0197983 A1 Sep. 7, 2006

(30) Foreign Application Priority Data

Feb. 18, 2005 (JP) ..... P2005-043267
May 9, 2005 (JP) ..... P2005-136687
Feb. 16, 2006 (JP) ..... P2006-039862

(51) Int. Cl.
*B41J 2/015* (2006.01)
*B41J 2/165* (2006.01)

(52) U.S. Cl. ..... 347/21; 347/28; 347/36

(58) Field of Classification Search ..... 347/21, 347/23, 28, 31, 32, 34, 35, 36, 95, 234, 22, 347/29, 30

See application file for complete search history.

(56) References Cited

U.S. PATENT DOCUMENTS 5,500,659 A * 3/1996 Curran et al. ..... 347/28
6,172,691 B1 * 1/2001 Belon et al. ..... 347/32
6,530,644 B2 * 3/2003 Premnath et al. ..... 347/35
7,204,577 B2 * 4/2007 Kanamitsu et al. ..... 347/31
2005/0225626 A1 * 10/2005 Igarashi et al. ..... 347/234
2006/0033792 A1 * 2/2006 Sano ..... 347/95

FOREIGN PATENT DOCUMENTS

EP 1 160 090 A1 12/2001
EP 1 256 455 A1 11/2002
JP 2003-211706 7/2003
JP 2005-153395 6/2005

OTHER PUBLICATIONS

European Search Report (mailed Mar. 30, 2007).

* cited by examiner

*Primary Examiner*—Stephen D Meier
*Assistant Examiner*—Rene Garcia, Jr.
(74) *Attorney, Agent, or Firm*—John J. Penny, Jr.; Catherine J. Toppin; Edwards Angell Palmer & Dodge LLP

(57) ABSTRACT

A method of recording control includes ejecting first liquid to a recording medium and a recessed portion that is situated at the outside of at least one of sides of the recoding medium thereby a recording is performed without a margin at the at least one of the sides of the recording medium; and ejecting second liquid to the recessed portion to wash away the first liquid in the recessed portion in a case where a predetermined condition is satisfied.

11 Claims, 13 Drawing Sheets

METHOD OF CONTROLLING LIQUID EJECTION FOR MARGINLESS PRINTING WITH WASTE LIQUID RECESS PORTION

BACKGROUND OF THE INVENTION

The present invention relates to a recording control method for ejecting liquid onto a recording medium, to thus perform recording.

Some inkjet printers, being a type of recording apparatus, can perform so-called marginless recording for effecting recording on at least one of the sides of a recording sheet, serving as a recording medium, without leaving a margin. An inkjet printer of such a type includes a recording head having a plurality of nozzle arrays through which ink droplets are ejected onto a recording sheet; a platen for supporting the recording sheet and regulating the position of the recording sheet in relation to the recording head; and a waste ink tank for storing waste ink therein. In the platen, there are formed a grooved hole into which ink deviated off an edge of the recording sheet is to be discarded; and a waste tank guide path adjacent to the ink-discarding grooved hole. The waste tank guide path is connected to the ink-discarding grooved hole and a waste tank inlet port. An ink-absorbing member made of a material having a high void ratio, such as a spongy polyurethane, is attached inside the waste ink guide path. Hence, ink having flowed into the waste ink guide path through the ink-discarding grooved hole is absorbed into the ink-absorbing member, and guided to the waste ink tank inlet port, to thus be stored inside the waste ink tank (refer to JP-A-2003-211706).

There are also inkjet printers using so-called pigment ink. As compared with dye ink, the pigment ink has exhibits lower permeability with respect to an ink adsorption layer on the surface of a recording sheet. Hence, as compared with the dye ink, the pigment ink also exhibits lower permeability with respect to the ink-absorbing member provided inside the waste ink guide path. Therefore, in an inkjet printer using the pigment ink, the ink-absorbing member provided inside the waste ink guide path must be made of a material exhibiting higher ink absorption. However, since an ink-absorbing member having high ink absorption simultaneously has a high ink retention capability, such an ink is likely to remain, and is less easily conveyed to the waste ink tank inlet port. Accordingly, a portion of the pigment ink may remain inside the ink-absorbing member or on the ink-absorbing member on the way of being guided to the waste ink tank inlet port.

SUMMARY

It is therefore an object of the invention to provide a method of controlling liquid ejection which can prevent remaining of liquid having been discarded.

In order to achieve the object, according to the invention, there is provided a method of recording control comprising:

ejecting first liquid to a recording medium and a recessed portion that is situated at the outside of at least one of sides of the recoding medium thereby a recording is performed without a margin at the at least one of the sides of the recording medium; and ejecting second liquid to the recessed portion to wash away the first liquid in the recessed portion in a case where a predetermined condition is satisfied.

The method may further comprise measuring a time period having elapsed since processing for executing the recording is started. The predetermined condition may include a condition in which the time period is equal to a predetermined time period.

The method may further comprise measuring an amount of the first liquid having been ejected to the recessed portion within a predetermined time period. The predetermined condition may include a condition in which the amount of the first liquid is no more than a predetermined amount.

The second liquid may be ejected after processing for executing the recording is finished.

The recording medium may include a first recording medium and a second recording medium having a larger size than the first recoding medium, and the second liquid may be ejected to a recessed portion that is situated at the outside of at least one of sides of the second recording medium.

The second liquid may be ejected to a recessed portion that is situated at the outside of at least one of sides of the largest recording medium used in the predetermined time period.

The second liquid may be ejected to the recessed portions that are situated at opposite sides of the recording medium.

The second liquid may have tendency not to be viscous.

The first liquid may include a first type of liquid and a second type of liquid, and the predetermined condition may include a condition in which an usage rate of the first type of liquid is no less than a predetermined usage rate.

The first type of liquid may have tendency to be viscous.

The predetermined usage rate may be proportion of an amount of consumption of the first type of liquid to an amount of consumption of the first liquid.

According to the invention, there is also provided a program product comprising a program for causing a computer to execute the method.

According to the invention, there is also provided a liquid ejecting apparatus operable to execute the method.

DETAIL DESCRIPTION OF PREFERRED EMBODIMENTS

Figure 1:
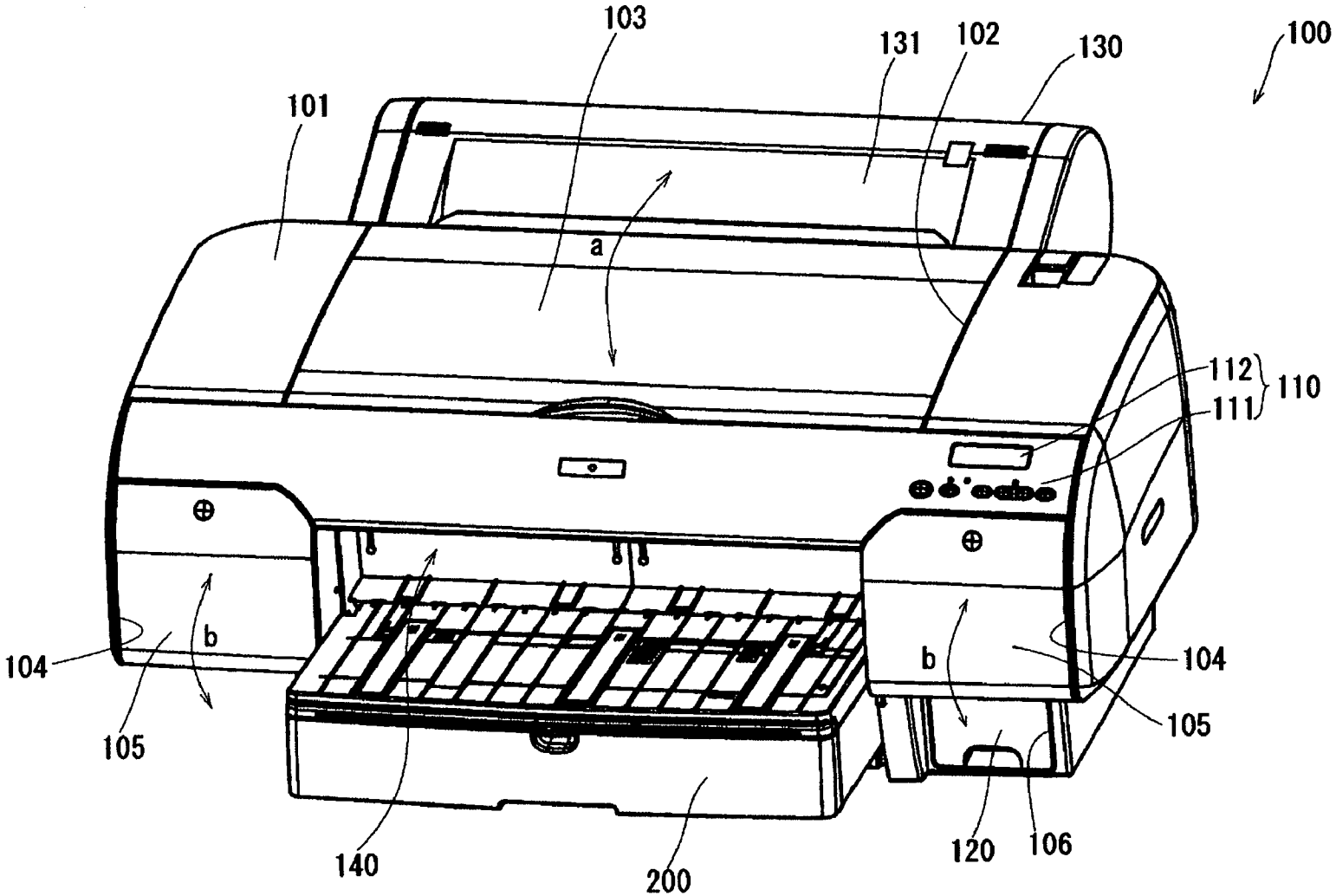
FIG. 1 is a perspective view of an entire external configuration of an inkjet printer, which is one of recording apparatuses according to an embodiment of the invention, as viewed from a forward oblique direction.

As shown in FIG. 1, the inkjet printer 100 is a desktop-type large printer which can perform printing on so-called cut sheets of comparatively large sizes ranging from, e.g., a JIS size A4 to a JIS size A2, and on a rolled sheet. The entire inkjet printer 100 is covered with a housing 101 which assumes the shape of a substantially rectangular solid elongated in its widthwise direction.

A rectangular window section 102 is formed in the upper surface of the housing 101. This window section 102 is covered with a transparent or semi-transparent window cover 103. The window cover 103 is attached so as to be pivotable in a direction indicated by an arrow "a" in the drawing about a pivot shaft which is provided in an upper portion of the window cover 103. By means of lifting the window cover 103 to thus open the window section 102, a user can perform maintenance operation, and the like, on the internal mechanism through the window section 102.

A cartridge storage section 104 is formed on each of right and left sides of the front surface of the housing 101; and a plurality of ink cartridges are inserted into and removed from the cartridge storage sections 104. Ink of respective colors for printing is respectively stored in the ink cartridges. Each of the cartridge storage sections 104 is covered with a transparent or semi-transparent cartridge cover 105. The cartridge cover 105 is attached so as to be pivotable in a direction indicated by an arrow "b" in the drawing about a pivot shaft, provided in a lower portion of the cartridge cover 105. By means of lightly pushing the cartridge cover 105, to thus release an engagement section and open the cartridge storage section 104, a user can perform a replacement operation of an ink cartridge, and the like.

An operation section 110 through which a command pertaining to a printer operation is input is provided above the cartridge storage section 104 on the right side of the front surface of the housing 101. The operation section 110 includes buttons 111 of a power system for effecting power-on/power-off; an operation system for controlling head positoning of a sheet, flushing of ink, and the like; a processing system for performing image processing, and the like; and the like; a liquid crystal display panel 112 for displaying a status; and the like. A user can operate the buttons 111 while watching the liquid crystal display panel 112 to make ascertainment.

A tank storage section 106, to and from which a waste liquid tank 120 is inserted and removed, is formed below the cartridge storage section 104 on the right side of the front surface of the housing 101. The waste liquid tank 120 stores waste ink, and the like, which is disposed at the time of cleaning of a recording head 162 (see FIG. 5), replacement of an ink cartridge, or marginless recording. A user can perform a disposal operation of the waste ink, and the like, stored inside the tank by means of pulling the waste liquid tank 120 frontward.

A sheet feeding section 130 for feeding a rolled sheet is provided on the back surface of the housing 101 in such a manner as to protrude upwardly rearward. An unillustrated rolled sheet holder, on which a single roll of rolled sheet can be set, is provided inside the sheet feeding section 130. A reclosable rolled sheet cover 131 of a flip-up type is attached onto the front surface of the sheet feeding section 130 so as to cover the unillustrated rolled sheet holder. By means of lifting the rolled sheet cover 131 to thus open the sheet feeding section 130, a user can perform attachment and removal of a rolled sheet, and other operations. Meanwhile, an upper surface of the rolled sheet cover 131 is formed into a sheet feeding guide surface on which a cut sheet can be fed and guided manually.

A sheet feed/output section 140, to and from which a sheet feed/output tray 200 is inserted and removed is formed in the center of the front surface of the housing 101; that is, between the pair of cartridge storage sections 104. Cut sheets not having been subjected to printing are loaded in the sheet feed/output section 140, and cut sheets or a rolled sheet having been subjected to printing (hereinafter called "post-printing cut sheets or a rolled sheet") is loaded on the same. Meanwhile, this sheet feed/output section 140 is also formed so as to enable manual feeding of a sheet which is too thick to be bent during the course of transportation.

A front portion of the sheet feed/output tray 200 is inserted to the sheet feed/output section 140, and fixed in such a manner that a rear portion of the sheet feed/output tray 200 projects. The sheet feed/output tray 200 is formed into a cassette type; and configured so that the cut sheets not having been subjected to printing, which are to be fed, are loaded in a stacked manner inside the sheet feed/output tray 200, and the post-printing cut sheets or rolled sheet to be output are loaded in a stacked manner on the same. The configuration of the sheet feed/output tray 200 as described above will now be described in detail by reference to FIGS. 2 to 4.

Figure 2:
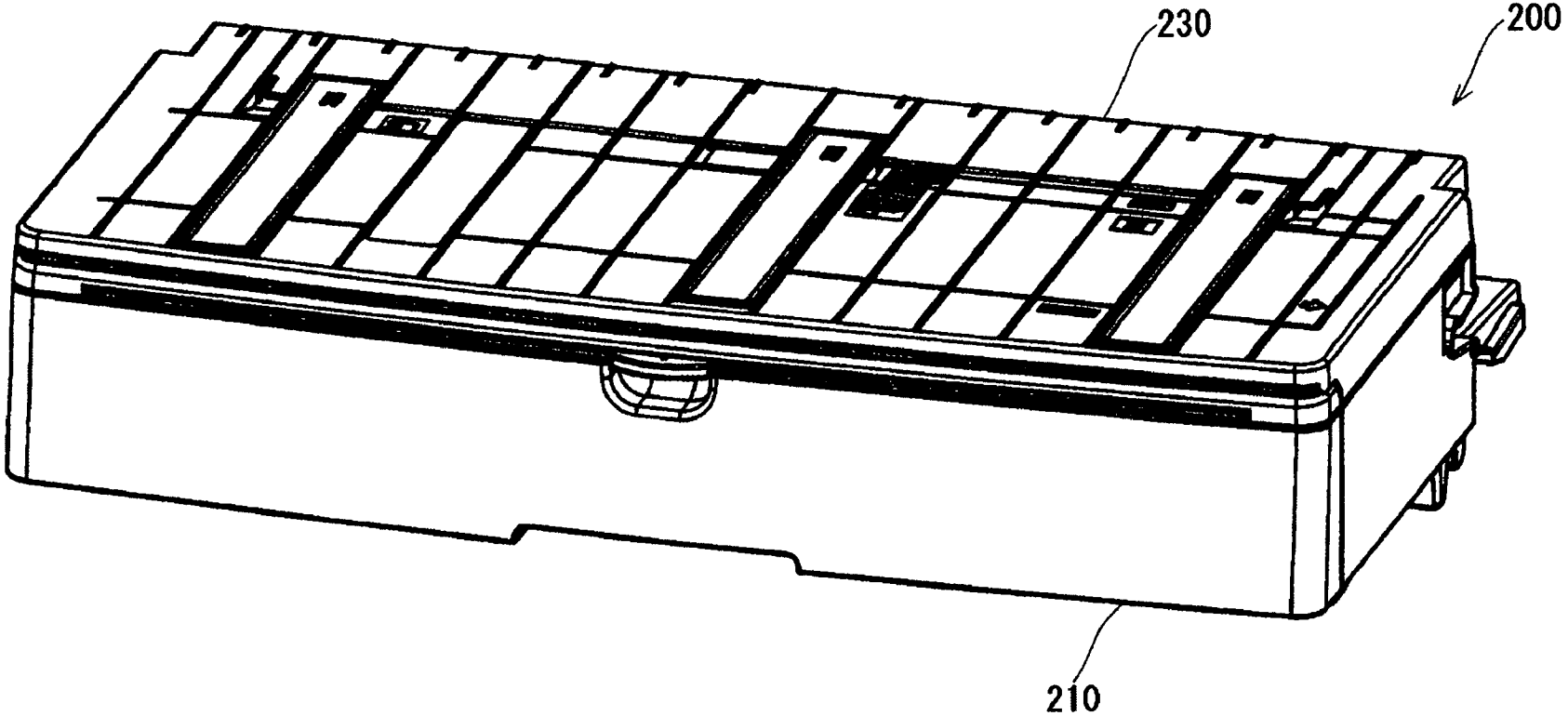
FIG. 2 is a perspective view of a sheet feed/output tray of the printer illustrated in FIG. 1.
Figure 3:
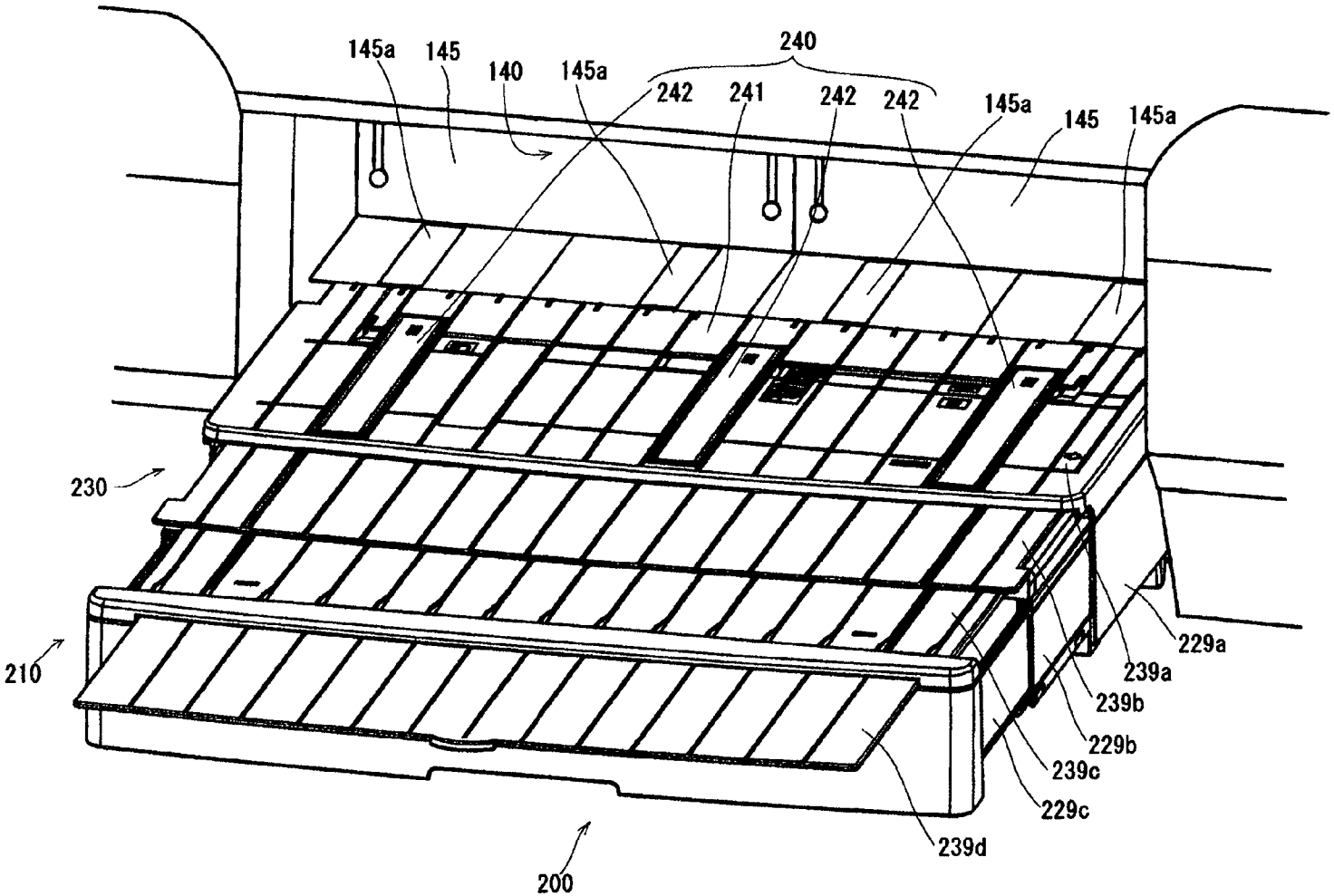
FIG. 3 is a perspective view of the sheet feed/output tray illustrated in FIG. 2, showing a status of being used.

As shown in FIG. 2, the sheet feed/output tray 200 includes a sheet feed tray 210 of a box shape, and a sheet output tray 230 of a lid shape covering the upper surface of the sheet feed tray 210. The sheet feed/output tray 200 is configured to be retractable in a sheet feed/output direction, and can be housed compact when not in use. The sheet feed/output tray 200 is configured to be capable of coping with cut sheets of various sizes.

In a case where cut sheets are loaded in a stacked manner, a rolled sheet guide 240 is housed in an upper surface portion of a sheet output member 239*a*; that is, the upper surface of the sheet output member 239*a* is formed into a flat surface. By virtue of this configuration, a cut sheet being output via a sheet output roller 155 (see FIG. 5) is smoothly loaded on an output sheet receiving surface formed from a side surface and a bottom surface of a guide section 145, which has an L-shaped cross-sectional profile, and upper surfaces of sheet output members 239*a* to 239*d*.

Meanwhile, a sponge mat 145*a* is affixed onto the bottom surface of the guide section 145. This sponge mat 145*a* functions to provide slip resistance for preventing, after a first cut sheet has been loaded, a leading end of a second cut sheet which has come to be output from abutting the first cut sheet and dropping the first sheet off the output sheet receiving surface.

Figure 4:
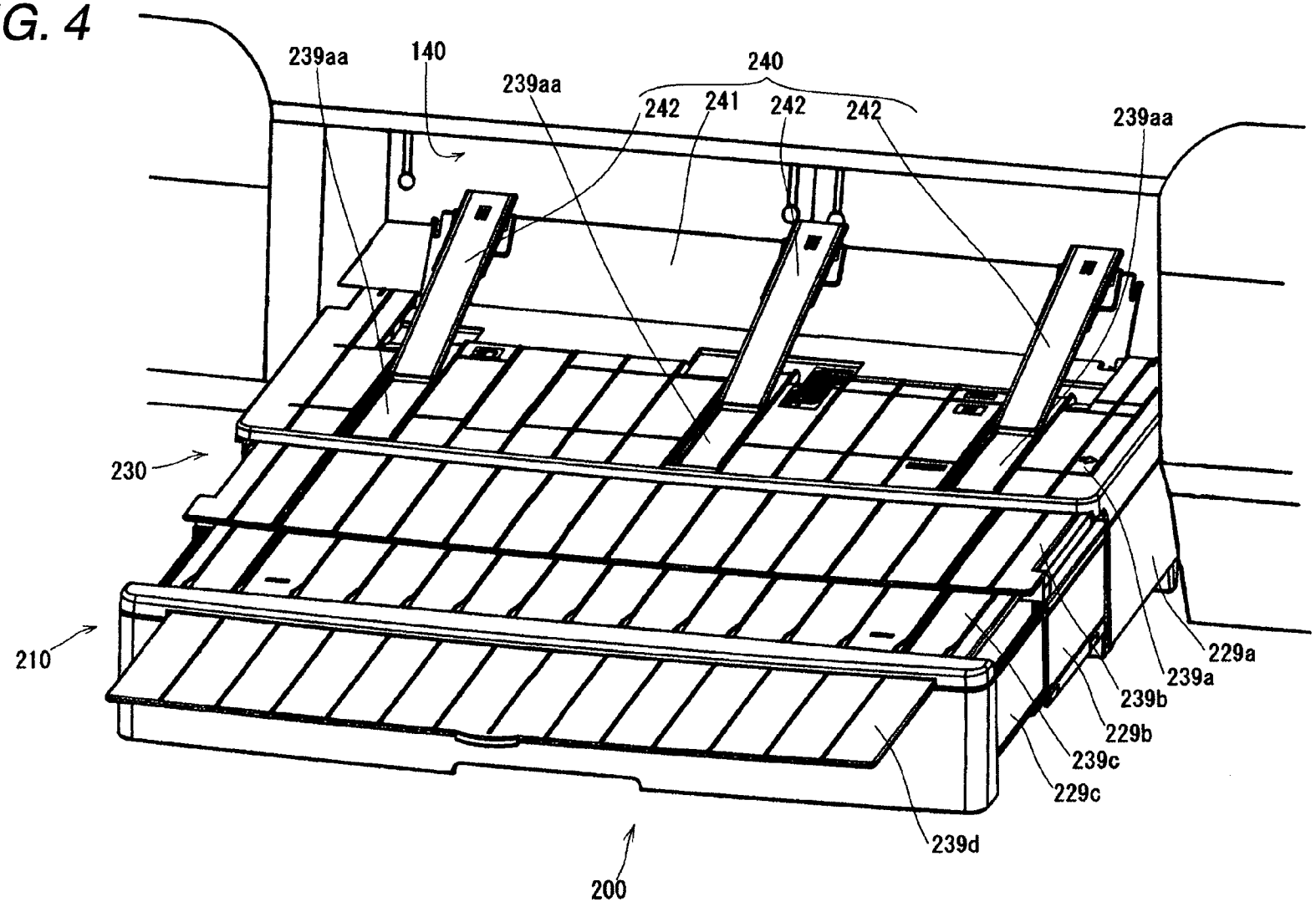
FIG. 4 is a perspective view of the sheet feed/output tray, illustrating another status of being used.

Meanwhile, in a case where a rolled sheet is loaded in a stacked manner, a user causes the rolled sheet guide 240 housed in the upper surface of the sheet output member 239*a* to swivel rearward as illustrated in FIG. 4 by means of hooking a long side thereof, the side opposite a first guide plate 241, with his/her finger. Hence, each of second guide plates 242 is pulled by the first guide plate 241, thereby lifting each of the second guide plate 242 at one end thereof in the longitudinal direction. As a result, an end on the other side of each of the second guide plates 242 in the longitudinal direction slides rearward along a respective groove 239*aa* formed in the upper surface of the sheet output member 239*a*. Subsequently, the first guide plate is caused to pivot until the angle formed with the first guide plate 241 and the corresponding second guide plate 242 becomes an acute angle.

Consequently, the one end of each of the second guide plates 242 in the longitudinal direction comes into the proximity of a top of the side surface of the guide section, thereby assuming a slide shape. By virtue of this shape, even when a rolled sheet being output through the sheet output roller is curled, the leading end of the rolled sheet slides on the second guide plates 242 of the slide shape, to thus be guided to the upper surfaces of the sheet output members 239*a* to 239*d* without the leading edge of the rolled sheet being entangled in the guide section side. Therefore, a rolled sheet is smoothly loaded, in a stacked manner, on the output sheet receiving surface formed from the second guide plates 242 and the upper surfaces of the sheet output members 239*a* to 239*d*.

The sheet feed/output section 140, a transport section 150, a recording section 160, a control section 170, and the like, are provided inside the housing 101. A hopper 141 for feeding cut sheets, a sheet feed roller 142, a separation member 143, and the like, are provided in the sheet feed/output section 140. The hopper 141 is formed into a flat plate so as to allow loading of cut sheets thereon; and is provided so that one end of the hopper 141 is located in the vicinity of the sheet feed roller 142 and the separation member 143, and the other end is located in the proximity of the bottom surface of the sheet feed tray 210 of the sheet feed/output tray 200 in a state of being attached at the other end. In addition, a compression spring 144 is attached to the hopper 141 in such a manner that one end of the compression spring 144 is attached to the bottom surface of the housing 101, and the other end of the spring is attached to one end of the back surface of the hopper 141. Hence, the hopper 141 is configured such that one end side thereof pivots about the other end side by elongation and contraction of the compression spring 144.

The sheet feed roller 142 is formed into a D-shape, a portion of which is notched in cross section, and rotates intermittently, thereby transporting a cut sheet on the hopper 141 by means of friction. The upper surface of the separation member 143 is formed into a rough surface so as to separate an underlayer sheet from an uppermost cut sheet by means of friction when the cut sheets are fed in multi-feed by the sheet feed roller 142. A relationship between the cut sheets loaded on the hopper 141 and the sheet feed roller 142 will now be described by reference to the drawings.

Figure 6A:
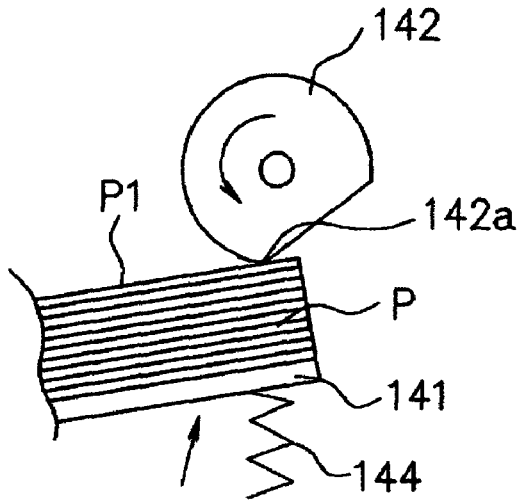
FIGS. 6A and 6B are views illustrating a contact status between sheets on a hopper and a sheet feed roller of the printer illustrated in FIG. 1.

FIG. 6A illustrates a case where a maximum number of cut sheets P are loaded on the hopper 141. These elements are adjusted so that, when the hopper 141 elevates from this status, an uppermost cut sheet P1 is not brought into contact with a notched section of the sheet feed roller 142, but with the perimeter thereof at a point later than at least an arc-starting point 142*a*.

Figure 6B:
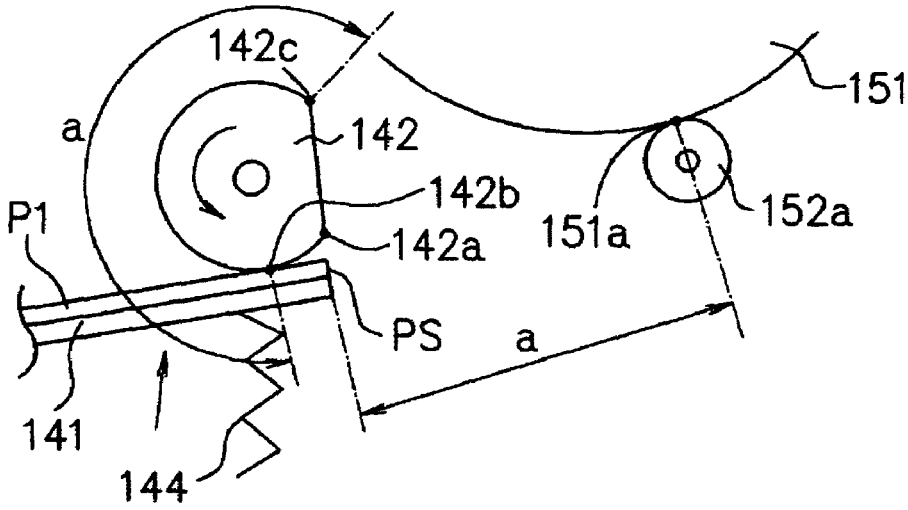

Meanwhile, FIG. 6B illustrates a case where a minimum number (one) of the cut sheets P1 is loaded on the hopper 141. These elements are adjusted so that, when the hopper 141 elevates from this status, the cut sheet P1 is brought into contact with the sheet feed roller 142 at a contact point 142*b* which comes after a small angle of rotation from the arc-starting point 142*a*. The contact point 142*b* is such a point that a perimeter length from the contact point 142*b* to an arc-ending point 142*c* becomes identical to a length "a," which is the length of a gap between a leading point "PS" of the sheet P1 and a contact point 151*a* between a sub roller 151 and its driven roller 152*a*.

When the above adjustment is adopted, the cut sheet P1 is not released off the sheet feed roller 142 until the leading end "PS" of the uppermost cut sheet P1 arrives at the contact point 151*a* between the sub roller 151 and its driven roller 152*a*, so long as the number of cut sheets P loaded on the hopper 141 is the maximum loading number or smaller. Therefore, the cut sheet P1 can be passed to the sub roller 151 without fail, thereby eliminating failure in sheet feeding.

The sub roller 151 and its driven rollers 152*a*, 152*b*, and 152*c*, for transporting a sheet; a sheet feed roller 153 and its driven roller 154; the sheet output rollers 155 and serrated rollers 156; detection sensors 157*a* and 157*b;* and the like, are provided in the transport section 150. The sub roller 151 nips a cut sheet having been fed from the sheet feed tray 210 together with the driven rollers 152*a*, 152*b*, and 152*c*, and reverse-transports the cut sheet in a U-shaped path, so as to output the cut sheet onto the sheet output tray 230. In addition, the sub roller 151 nips a rolled sheet having been fed from the sheet feed section 130 together with the driven roller 152*c*, and transports the rolled sheet so as to output the rolled sheet onto the sheet output tray 230.

The sheet feed roller 153 nips the rolled sheet having been reverse-transported or the roiled sheet having been fed together with the driven roller 154, thereby feeding the same to a platen 163. The sheet feed roller 155 nips the sheet passing by the platen 163 together with the serrated roller 156, thereby outputting the same onto the sheet output tray 230. The detection sensor 157*a* determines a transportation distance for elimination of skewing of the cut sheet being fed. The detection sensor 157*b* determines a transportation distance for head positioning of the cut sheet under reverse-transportation or the rolled sheet under transportation.

A carriage 161, the recording head 162, the platen 163, a suction duct 164, a waste ink flow section 165, and the like, are provided in the recording section 160. The carriage 161 is coupled with an unillustrated carriage belt. When the carriage belt is activated by an unillustrated carriage drive device, the carriage 161 is driven in a linked manner by the motion of the carriage belt, thereby reciprocating while being guided by an unillustrated guide shaft.

Figure 5:
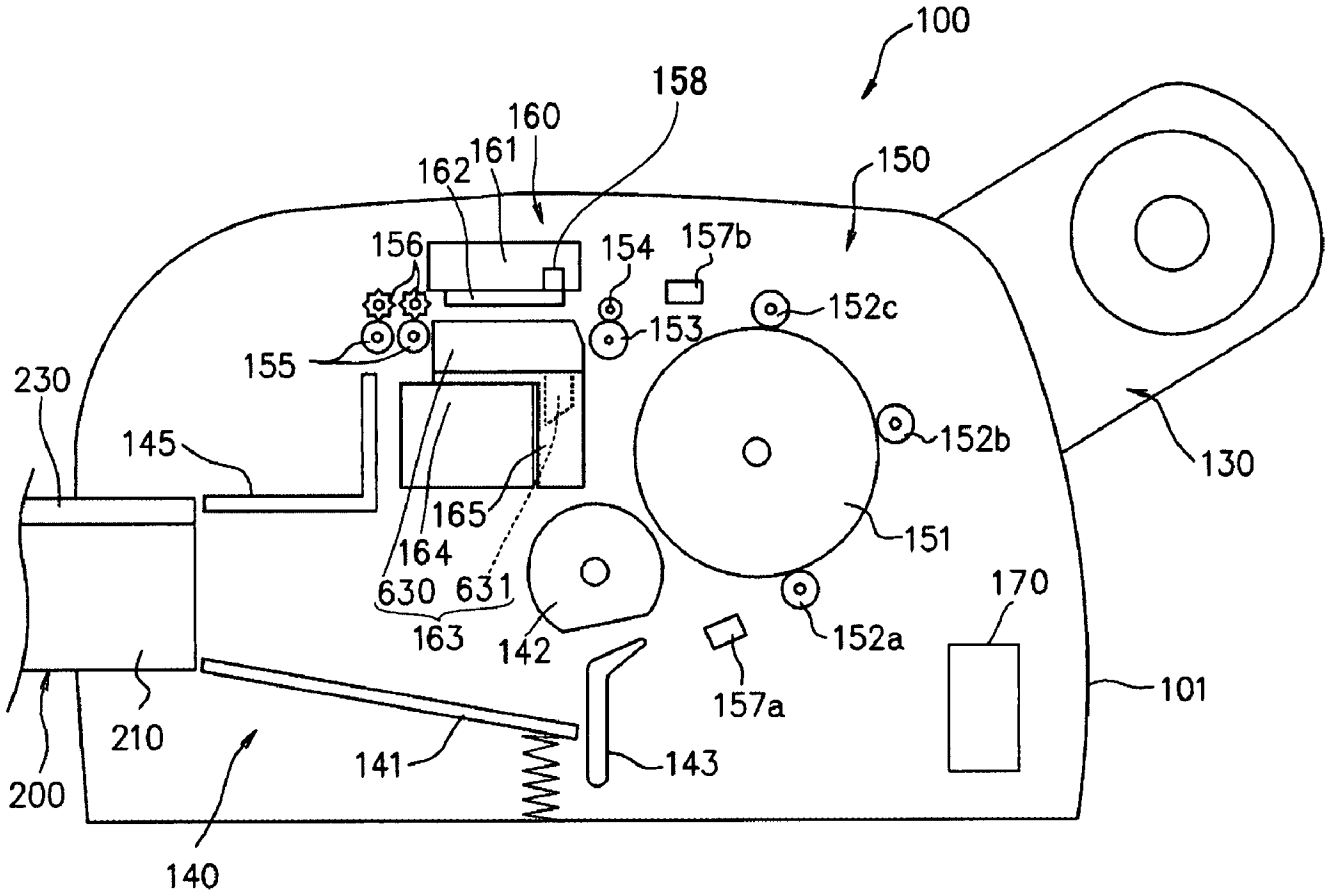
FIG. 5 is a cross-sectional side view illustrating an overview of an internal configuration of the printer illustrated in FIG. 1.

The carriage 161 is provided with a sheet-width detection sensor 158, as shown in FIG. 5, and moves together with it in the main scanning direction. The sheet-width detection sensor 158, which is an optical type sensor, emits light to the sheet on the platen 163 and receives the light reflected by the sheet so as to detect the sheet, that is, the end of the sheet in the main scanning direction.

The recording head 162 has, for instance, a black ink recording head for ejecting black ink, and a plurality of color ink recording heads for respectively ejecting one of four colors constituted of cyan, magenta, and yellow. Pressure generation chambers, and nozzle orifices connected therewith are provided in the recording head 162. The recording head 162 is configured such that a predetermined pressure is applied on ink stored in the pressure generation chamber, thereby ejecting an ink droplet of a controlled size against a sheet through the nozzle orifice.

The platen 163 includes a platen main body 630 and a plurality of platen vertical sections 631. The platen main body 630 is formed into an elongated, substantially rectangular flat plate extending in the main scanning direction over a length slightly larger than the width of a sheet of a maximum size on which recording can be effected. Each of the platen vertical sections 631 extends in a downwardly vertical direction from the lower surface of the platen main body on the upstream side thereof in the transport direction. The platen 163 is located so as to be between the sheet feed roller 153 and the sheet output roller 155, and oppose the recording head 162. The platen 163 supports a sheet having been transported, with a face of the platen main body 630. Detailed descriptions of the platen 163 configured as above will be further provided by reference to drawings.

Figure 7:
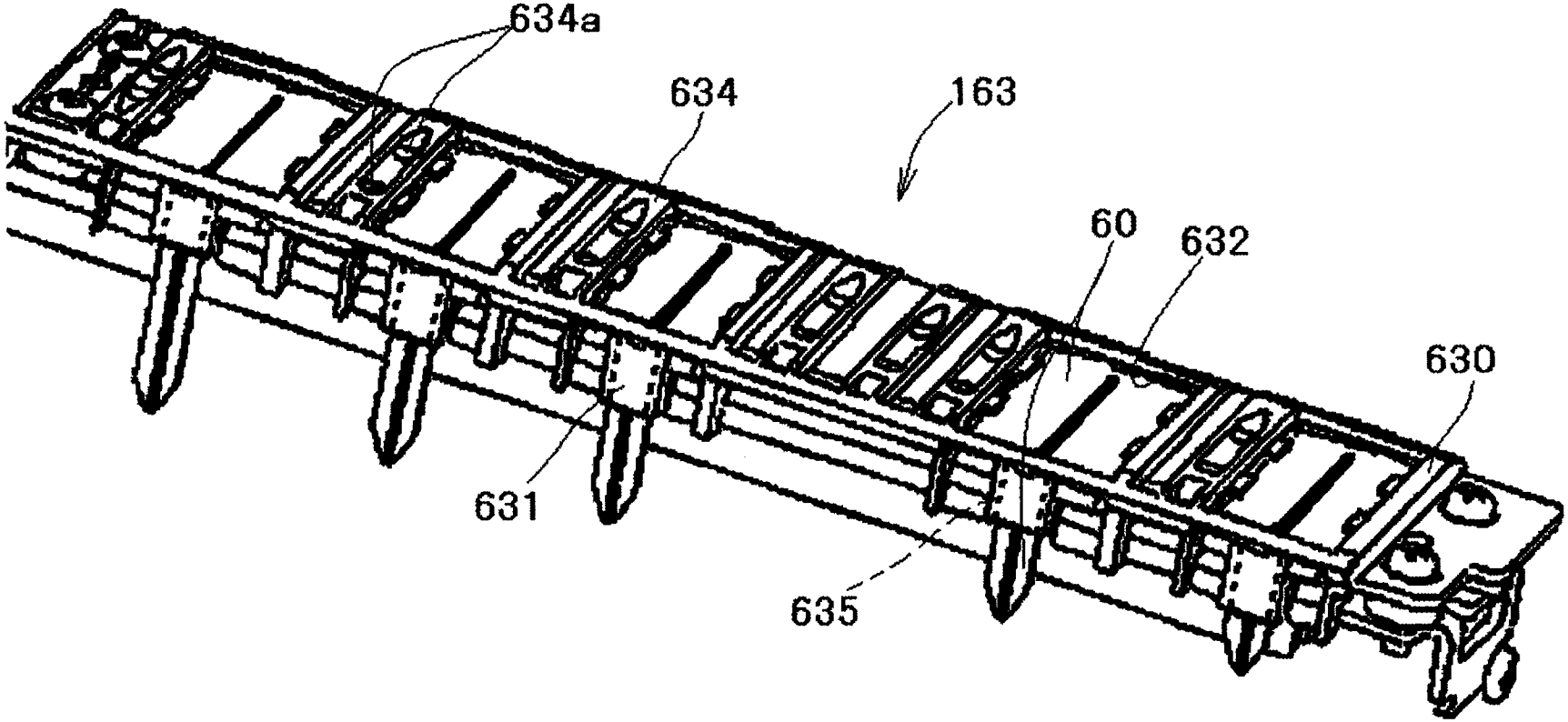
FIG. 7 is a perspective view illustrating details of a platen of the printer illustrated in FIG. 1.
Figure 8:
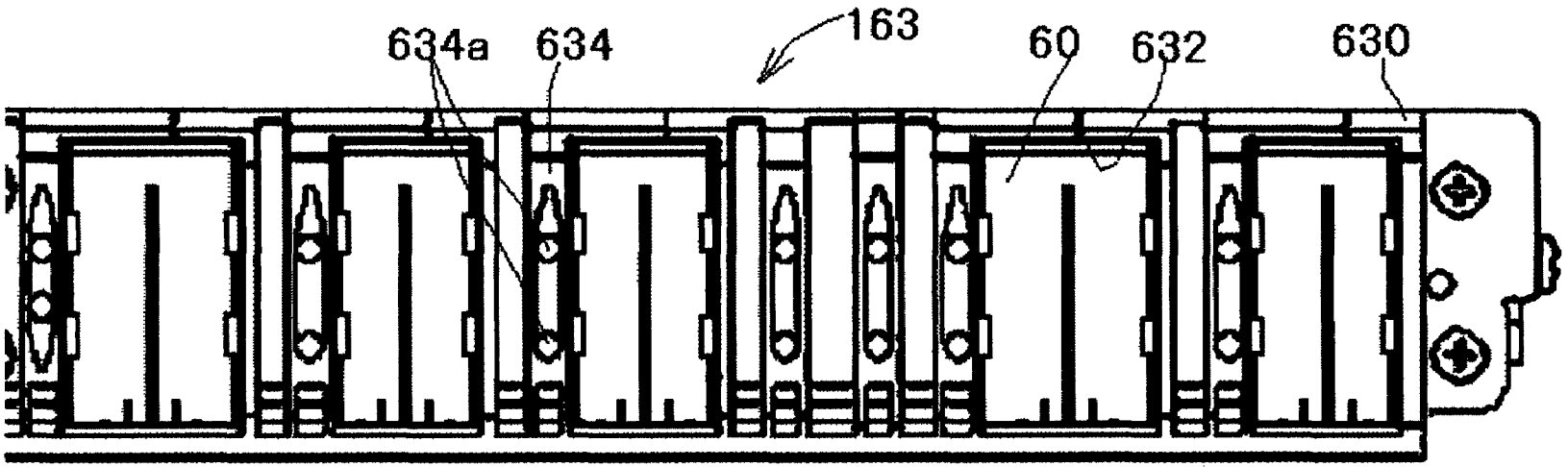
FIG. 8 is a plan view of the platen illustrated in FIG. 7.

As shown in FIGS. 7 and 8, a substantially-rectangular ink discard grooved hole 632, into which ink droplets ejected out of the end of the sheet during recording that is performed without the margin at the at least one of the sides of the sheet, that is, marginless recording are to be discarded, is formed in an upper surface of this platen main body 630. In FIGS. 7 and 8, a plurality of the ink discard grooved holes 632 are arranged in the width direction of the platen 163. An ink discard grooved hole extending in the width direction may be formed in the upper surface of this platen main body 630. In this case, the ink discard grooved hole extending in the width direction corresponds to the end of the sheet in the sheet feed direction. A waste ink passage 635 connected from the ink discard grooved hole 632 to the waste ink flow section 165 is formed inside the respective platen vertical section 631 An ink-absorbing member 60 is attached to the platen main body 630 over a portion ranging from the ink discard grooved hole 632 to the waste ink passage 635 in the platen vertical section 631. The ink-absorbing member 60 absorbs waste ink discarded into the ink discard grooved hole 632, and guides the same to the waste ink flow section 165.

In addition, a plurality of ribs 634 extending along the sheet transport direction are arranged on the upper surface of the platen main body 630 on both sides of the ink discard grooved hole 632 with predetermined intervals therebetween. Each of the ribs 634 is substantially trapezoidal in cross section taken along the main scanning direction, and formed into a rail shape. A plurality of suction holes 634*a* communicating with the suction duct 164 are formed on a top face of each of the ribs 634 in two rows along the sheet transport direction.

The suction duct 164 is provided directly below the platen 163, and formed into a gutter shape extending along the main scanning direction so as to be capable of covering all the suction holes 634*a*. In addition, an unillustrated suction fan is connected to one end of the suction duct 164. When the suction fan is rotated in the above configuration, air taken in through the respective suction holes 634*a* passes through the suction duct 164, and is output to the outside through the suction fan. By virtue of this configuration, when a sheet is supplied on the upper surface of the platen 163, negative pressure is produced on the lower surface side of the sheet, and the sheet is sucked onto the top faces of the respective ribs 634. Hence, the sheet can be prevented from being lifted up, thereby maintaining the recording accuracy at a high level.

The waste ink flow section 165 is formed into a container shape whose upper surface is open and which extends along the main scanning direction. This waste ink section 165 is substantially identical in length with the platen main body 630, and formed into an elongated rectangular solid whose upper surface is open and whose bottom surface is inclined from an upper end of one side surface of the waste ink section 165 toward a lower end of the other side surface of the same. An ink-absorbing member similar to the above-described ink-absorbing member 60 is provided on this bottom surface of the waste ink flow section 165. The waste ink tray 165 is configured so as to receive waste ink flowing down through the ink-absorbing member 60 during marginless recording with the ink-absorbing member on the bottom surface, and conveys the same in a downward oblique direction, thereby causing the waste ink to flow into the waste liquid tank 120.

The control section 170 has an unillustrated main substrate which forms a printer controller. Unillustrated control devices and storage devices, such as a CPU, ROM, RAM, and an ASIC, and other various circuit devices are mounted on the main substrate. The control section 170 is configured such that recording control programs stored in the ROM control the sheet feed/output section 140, the transport section 150, the recording section 160, and the like, which form a printing engine. When marginless recording is performed particularly with use of pigment ink, ink discarded to the outside of the sheet may remain inside the ink-absorbing member or on the ink-absorbing member on the way where the pigment ink having been discarded is guided to the waste liquid tank 120 from the waste ink flow section 165. To this end, the control section 170 performs the following control.

Figure 9:
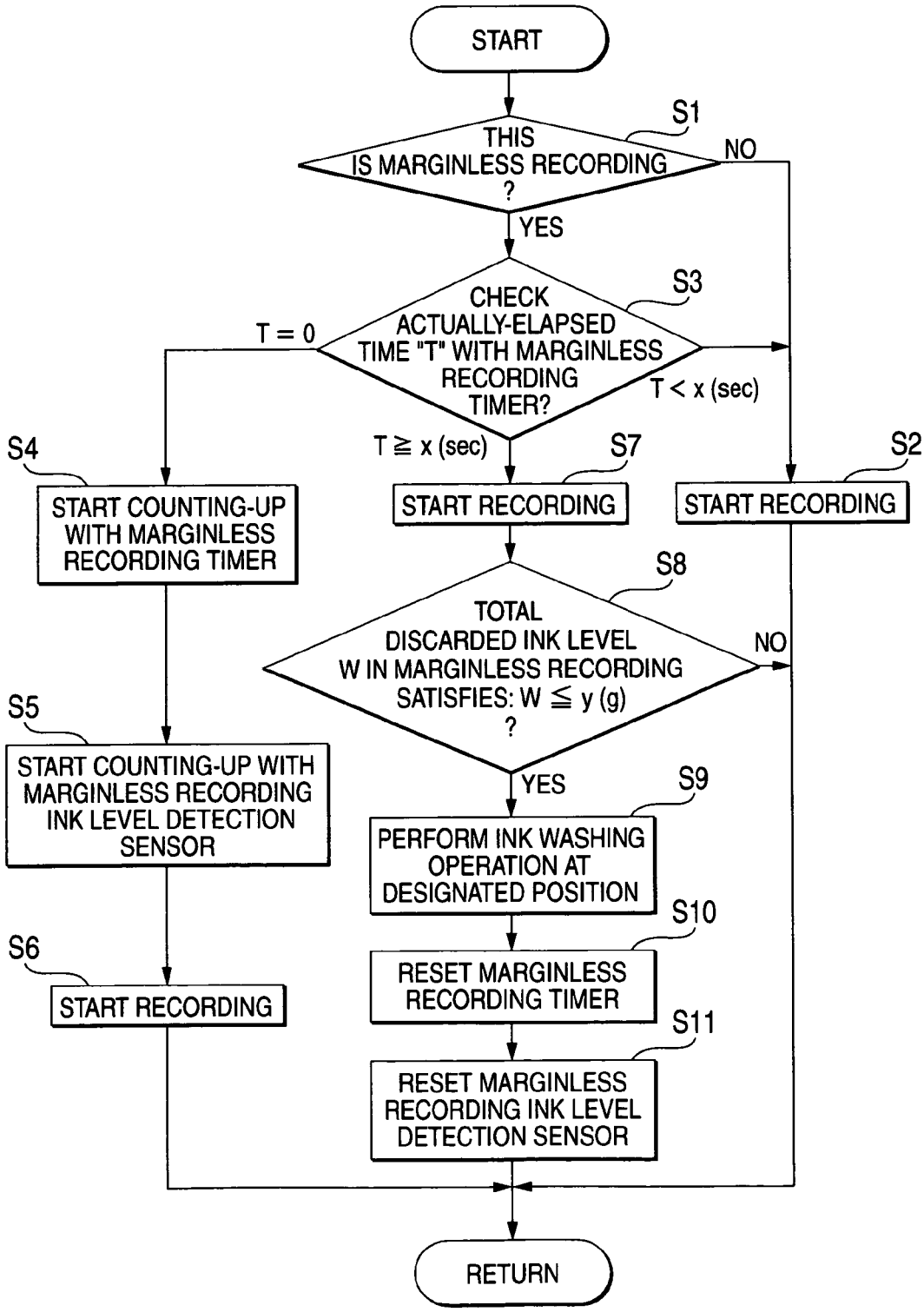
FIG. 9 is a flowchart for describing an embodiment of a method of controlling liquid ejection of the invention.

As shown in FIG. 9, first, an ascertainment is made as to whether or not the present recording operation is marginless recording (step S1). When recording is ascertained not to be marginless recording, margined recording is started, and processing returns to a main program (step S2). Meanwhile, when in step S1 the target printing is ascertained to be marginless recording, a marginless recording timer for measuring an actually-elapsed time T, which is a duration from a point in time where transition from the margined recording to the marginless recording has occurred, is checked (step S3).

When the actually-elapsed time T is 0, counting-up of the marginless recording timer is started (step S4); and, in addition, counting-up of a marginless recording ink level detection sensor for measuring an amount of discarded ink (hereinafter called a "discarded ink level") W in marginless recording is started (step S5). Then, marginless recording is started, and processing returns to the main program (step S6). Meanwhile, when the actually-elapsed time T does not exceed a predetermined elapsed time "x," marginless printing is started, and processing returns to the main program (step S2).

Meanwhile, when the actually-elapsed time T is the predetermined elapsed time "x" or longer, marginless recording is started (step S7); and an ascertainment is made as to whether or not the total discarded ink level W is equal to a predetermined ink level "y" having been set in advance or lower (step S8). When the total discarded ink level W exceeds the predetermined ink level "y," processing returns to the main program. Meanwhile, when the total discarded ink level W is the predetermined ink level "y" or lower, an ink washing operation (ejecting liquid to the ink discard grooved hole 632 to wash away the liquid in the ink discard grooved hole 632) is performed at a designated position (step S9); counting-up by the marginless recording timer and counting-up by the marginless recording ink level detection sensor are reset (step S10); and processing returns to the main program (step S11).

The ink having been discarded during marginless recording is washed away as described above. Therefore, ink can be prevented from remaining inside the ink-absorbing member or on the ink-absorbing member on the way where the ink is guided to the waste liquid tank 120 from the waste ink flow section 165. Inks which are likely to remain in this case are magenta and black, whose viscosities are easily increased. Accordingly, an ink which has a tendency not to be viscous, such as cyan or yellow, is employed for the ink washing operation. As a result, the cyan or yellow ink used for washing does not remain, and can be washed away together with ink of magenta and black.

In addition, the ink washing operation is configured so as to be performed when predetermined conditions are satisfied based on determinations of: the actually-elapsed time T, which is a duration from a point in time where transition from margined recording to the marginless recording has occurred as measured with the marginless recording timer; and the discarded ink level W during marginless recording measured with the marginless recording ink level detection sensor.

Accordingly, discarded ink can be prevented from being solidified due to time-varying deterioration. In conjunction therewith, the discarded ink can also be prevented from remaining because of being too small in amount to flow. Alternatively, the transition to the ink washing operation may be effected based on determination of only either the actually-elapsed time T or the discarded ink level W.

In addition, since the ink washing operation is performed after the predetermined condition has been satisfied and the recording operation has been performed, the ink washing operation can be performed in succession to the recording operation, thereby shortening a period of time required for the series of operations. A designated position where the ink washing operation is performed at this time is the ink discard grooved hole 632 located outside of each of opposite edges of a sheet of the maximum size among sheets with which the inkjet printer 100 can cope. By virtue of this configuration, ink used for washing which flows along the bottom surface of the waste ink flow section 165 from the upper end of the one side surface thereof to the lower end of the other side surface can wash away all the ink remaining at the ink-absorbing member located on the bottom surface. Furthermore, ink used for washing which flows at the lower end of the other side surface of the waste ink flow section 165 can completely wash away ink which has unintentionally remained at this position.

Meanwhile, the ink washing operation may be performed outside of each of opposite ends of a maximum sheet among sheets having been subjected to marginless recording performed within the predetermined elapsed time "x." By means of employing this configuration, an amount of ink required for washing can be suppressed to a small value. Meanwhile, in the above, the ink washing operation is performed outside of each of the opposite ends of the sheet However, the ink washing operation may be alternatively performed only on the side surface where ink flows along the bottom surface of the waste ink flow section 165 from the upper end of the one side surface thereof to the lower end of the other side surface. By means of employing this configuration, the amount of ink required for washing can be further suppressed to a small value.

Meanwhile, an amount of ink consumed (hereinafter called a "consumed ink level") in the ink washing operation increasingly grows for a user who performs a large amount of marginless recording, thereby increasing the cost for ink. In particular, the above problem becomes significant in a large inkjet printer for professional use, such as a so-called eight-color printer whose ink colors are constituted of cyan, magenta, yellow, photo black light cyan, light magenta, gray, and matt black, rather than a small inkjet printer for home use; a so-called four-color printer whose ink colors are constituted of cyan, magenta, yellow, and black. The above problems can be solved by means of performing the ink washing operation only when a certain ink of a predetermined amount is discarded. Hence, the control section 170 performs the following control.

Figure 10:
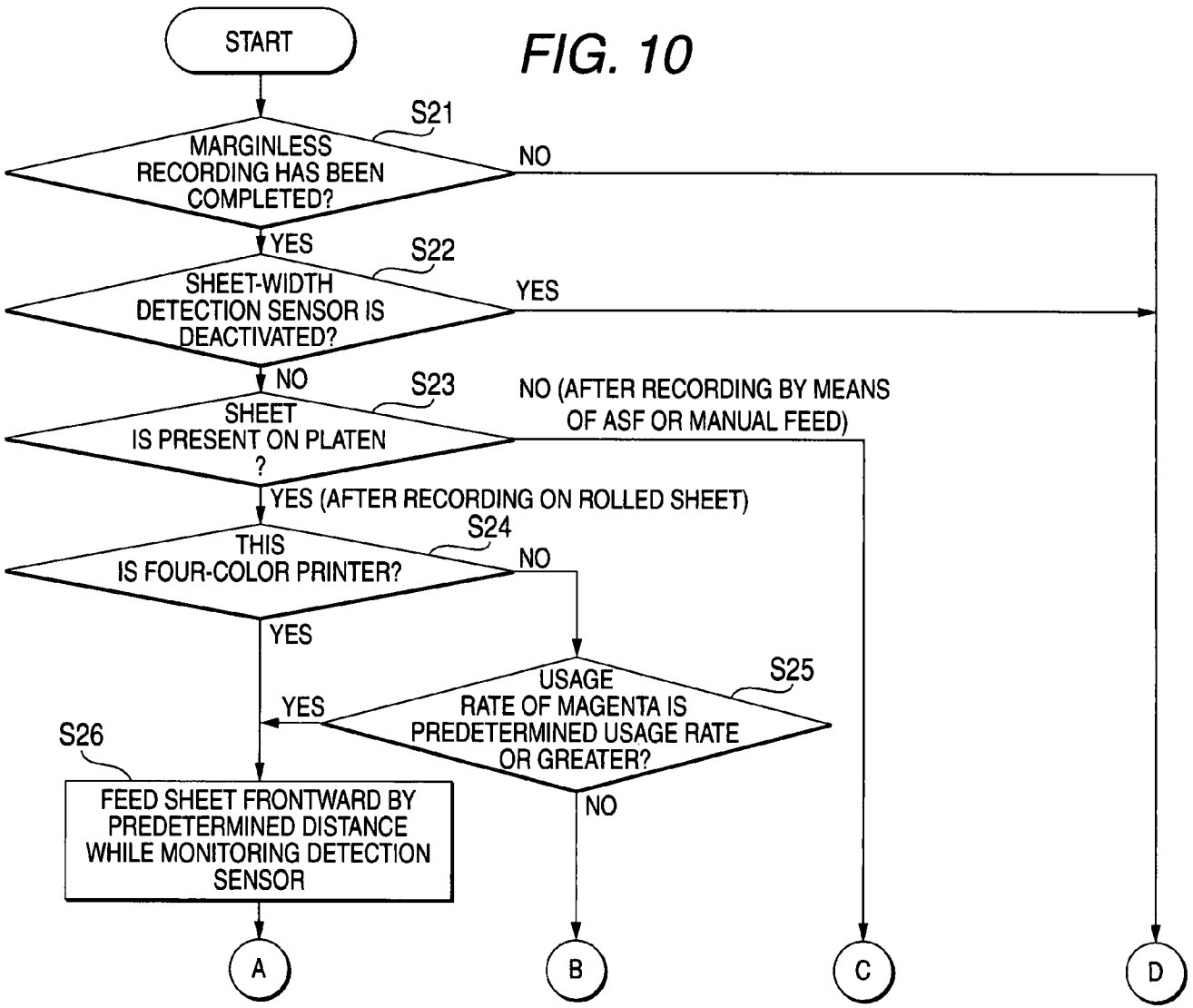
FIG. 10 is a first flowchart for describing another embodiment of the method of controlling liquid ejection of the invention.
Figure 11:
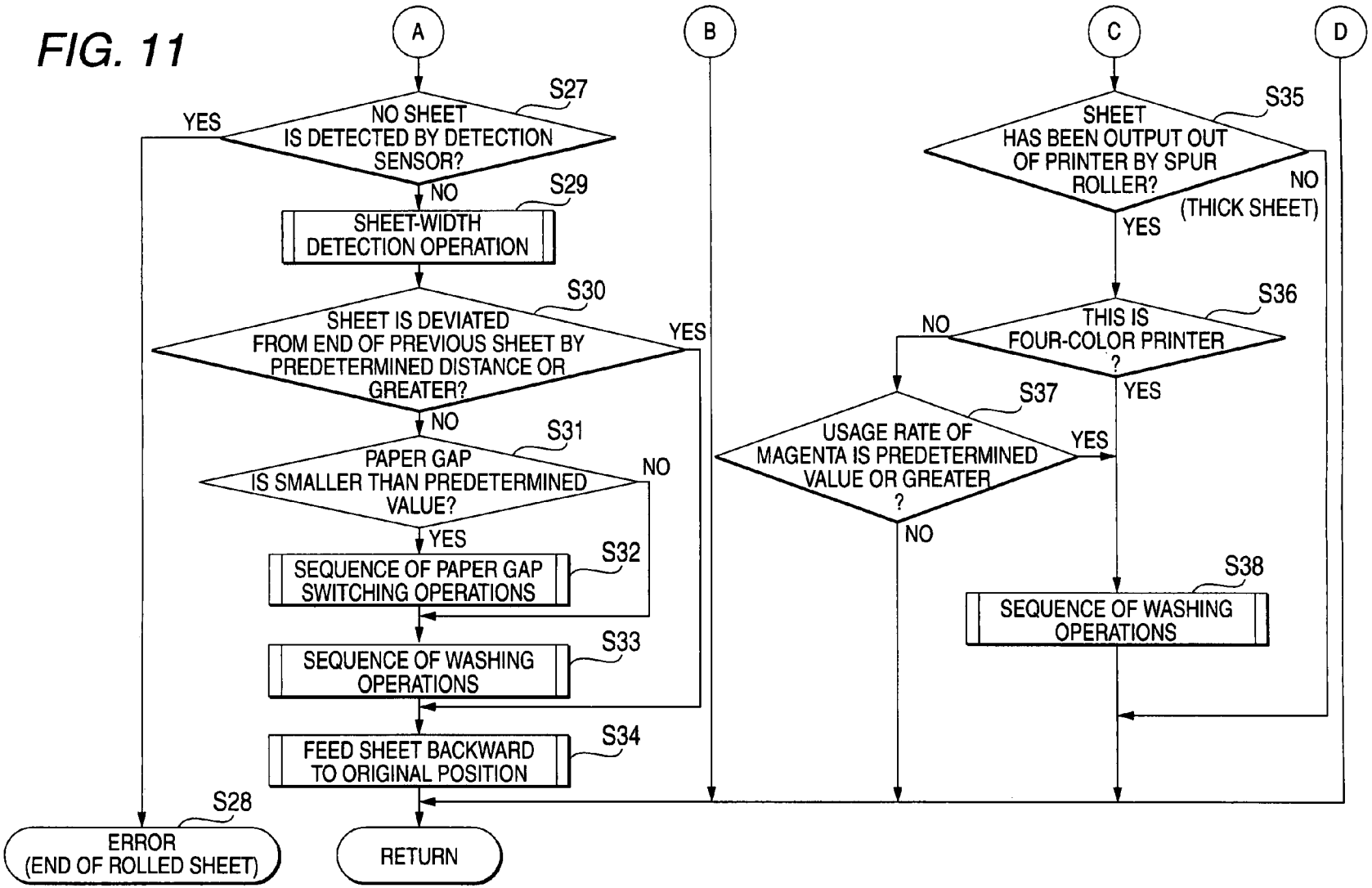
FIG. 11 is a second flowchart for describing another embodiment of the method of controlling liquid ejection of the invention.

As shown in FIGS. 10 and 11, first, a check is made as to whether or not marginless recording has been completed (step S21). When the marginless recording has not been completed, processing returns to the main program. On the other hand, when completion of the marginless recording is ascertained in step S21, an ascertainment is made as to whether or not the sheet-width detection sensor 158 is deactivated (step S22). When the sheet-width detection sensor 158 is ascertained to be deactivated, processing returns to the main program.

Meanwhile, when in step S22 the sheet-width detection sensor 158 is ascertained to be activated, an ascertainment is made as to whether or not a sheet is present on the platen 163 (step S23). When a sheet is ascertained to be present on the platen 163, recording on a rolled sheet is determined to have completed, and an ascertainment is made as to whether or not the inkjet printer 100 is a four-color printer (step S24). When in step S24 the inkjet printer 100 is ascertained to be an eight-color printer, an ascertainment is made as to whether or not a usage rate of an ink of a specific color is a predetermined usage rate or greater (step S25).

As described above, a consumed ink level in the ink washing operation increasingly grows for a user who performs a large amount of marginless recording, thereby increasing the cost for ink. To this end, after implementation of the marginless recording, the ink washing operation is performed only when a usage rate of ink of a specific color; e.g., ink of a color which has a tendency to be viscous and is easily solidified (likely to accumulate), is a predetermined usage rate or greater. More specifically, for instance, the ink washing operation is performed only when proportion of a consumed amount of magenta ink to that of ink of all colors is 40% or greater. Since conditions in which ink is accumulated in an eight-color printer are limited, this value of 40% is a value which is set for making the determination in consideration of a throughput, and the value is not limited to 40%. Meanwhile, photo black or matt black may be employed in place of magenta.

The above-described consumed ink level is an amount of consumed ink in a cartridge in a duration from provision of a command to start recording to completion of the recording (including a case where the recording is caused to be end by resetting). Therefore, ink consumed by flushing performed at a start of recording, cleaning based on timer setting, periodic flushing, and the like, is also included in calculation of the usage rate. Meanwhile, in calculation of the usage rate, an overflow is included, and low-order 4 bits of the consumed ink level are ignored.

When in step S25 the usage rate of magenta ink is determined to be smaller than 40%, processing returns to the main program. Meanwhile, when the usage rate of magenta ink is determined to be 40% or greater, the sheet is fed frontward by a predetermined distance; e.g., a length of a white portion of a rolled sheet (25.4 mm (#180−#1)+8.58 mm (#1−multisensor)+10 mm (margin)=43.98 mm) (step S26) while monitoring the detection sensor 157*b*.

The reason for performing this frontward feeding is as follows. An end of the sheet must be detected accurately for preventing ejection, onto the sheet, of ink used for the ink washing operation. Essential requirements for attaining this accurate detection of the end of the sheet are that the sheet is located at a reading point for the detection sensor 157*b*, and that the sheet is in a stable condition when the end of the sheet is detected by the detection sensor 157*b*. Therefore, the above respective conditions are satisfied by means of effecting the frontward feeding.

Presence or absence of the sheet is ascertained based on a detection signal detected by the detection sensor 157*b* (step S27), and when the sheet is determined to be absent on the basis of the detection signal detected by the detection sensor 157*b*, error handling; that is, an operation for an end of the rolled sheet, is performed (step S28). Meanwhile, when in step S27 a sheet Is determined to be present based on the detection signal detected by the detection sensor 157*b*, the sheet-width detection sensor 158 is activated (step S29), and an ascertainment is made as to whether or not the sheet is deviated (skewed) from an end position of a previous sheet by a predetermined distance; e.g., 3 mm, or greater (step S30).

When the sheet is found to be deviated by the predetermined distance or greater from the end position of the previous sheet, the sheet is fed backward so as not to perform washing on the sheet (step S34), and processing returns to the main program. Recording on a rolled sheet is usually performed without using the spur rollers 156. Therefore, the sheet is returned to a position where the same was located at a start of this sequence of operations in consideration of imprinting of the spur rollers which may be formed on the sheet as a result of reciprocating motion of the sheet. Meanwhile, when the sheet is to be cut, the spur rollers 156 are switched after this operation.

Meanwhile, when in step S30 the sheet is found to be deviated by less than the predetermined distance from the end position of the previous sheet, an ascertainment is made as to whether or not a paper gap [a distance between a surface of the recording head 162 where the nozzles are formed and the upper surface of the platen 163 (a recording surface of the sheet)] is smaller than a predetermined value (step S31). When the paper gap is smaller than the predetermined value, the paper gap is switched so as to become the predetermined value (step S32).

The reason for switching the paper gap so as to become the predetermined value is as follows. When the paper gap is too small, ink mist produced during the ink washing operation may adhere to the back surface of the sheet, thereby contaminating the back surface of the sheet. In contrast, when the paper gap is too great, a large amount of ink mist produced during the ink washing operation may splash inside the recording apparatus, thereby accelerating contamination inside the apparatus. To this end, the paper gap is switched to an appropriate value, thereby avoiding occurrence of the respective problems.

There is employed such a configuration that the paper gap can be switched so as to become uniform irrespective of a type of the sheet (the thickness of the sheet). In the inkjet printer 100 of the present embodiment, switching can be effected among, e.g., five levels constituted of 0.7 mm: extra thin sheet (cut sheet), 1.2 mm: thin sheet (cut sheet), 1.5 mm: ordinary sheet (cut sheet), 2.1 mm: rolled sheet, and 2.6 mm: thick sheet (cardboard). When the paper gap is switched to 0.7 mm, 1.2 mm, or 1.5 mm, the back surface of the sheet is contaminated; and when the same is switched to 2.6 mm, the inside of the recording apparatus is contaminated. To this end, the paper gap is switched to 2.1 mm, thereby avoiding occurrence of the above respective problems.

When the paper gap is the predetermined value or greater after the paper gap is switched or in step S31, the sequence of the ink washing operations subsequent to the marginless recording operation is performed (step S33). Then, the sheet is fed backward to its original position (step S34), and processing returns to the main program. Meanwhile, an actual operation for switching the paper gap is performed after a first flushing in the sequence of the ink washing operations.

Meanwhile, when in step S23 no sheet is ascertained to be present on the platen 163, a determination is made as to whether recording of a sheet fed by automatic sheet feeding (ASF) or manual feeding is completed; and an ascertainment is made as to whether or not a sheet has been output out of the printer by the spur rollers 156 (step S35). When the sheet is ascertained to have not been output out of the printer by the spur rollers 156, the sheet is determined to be a thick sheet, such as cardboard, and processing returns to the main program. Meanwhile, the inkjet printer 100 is configured such that, when recording on the thick sheet is finished, the inkjet printer 100 releases a thick sheet from a nipped status, and shifts to a standby state. Accordingly, the sequence of the ink washing operations is not carried out in this status where the sheet remains inside the printer, since the carriage 151 abuts the sheet.

Meanwhile, when in step S35 the sheet is output out of the printer by the spur rollers 156, an ascertainment is made as to whether or not the inkjet printer 100 is a four-color printer (step S36). When in step S36 the inkjet printer 100 is ascertained to be an eight-color printer, a check is made as to whether or not a usage rate of magenta ink is 40% or greater (step S37). When in step S37 the usage rate of magenta ink is ascertained to be smaller than 40%, processing returns to the main program.

When in step S37 the usage rate of magenta ink is ascertained to be 40% or greater, the sequence of the ink washing operations subsequent to the marginless recording operation is performed (step S38), and processing returns to the main program. As a result of the above procedure, the consumed ink level in the ink washing operation is regulated, and ink used for the ink washing operation can be reduced. Hence, the cost of ink imposed on a user of an eight-color printer who performs a large amount of marginless recording can be reduced.

Operations for a case where a cut sheet is printed by the inkjet printer 100 having the above configuration will be described by reference to FIGS. 12A to 13B. When the cut sheets P are loaded in a stacked manner in the sheet feed tray 210 of the sheet feed/output tray 200 attached to the sheet feed/output section 140, the bundle of the sheets is pressed against the sheet feed roller 142 by elevation of the hopper 141 caused by resiliency of the compression spring 144 which is mechanically synchronized with rotation of the sheet feed roller 142. As a result, only an uppermost cut sheet P is separated by the separation member 143, to thus be fed to the transport section 150.

Figure 12A:
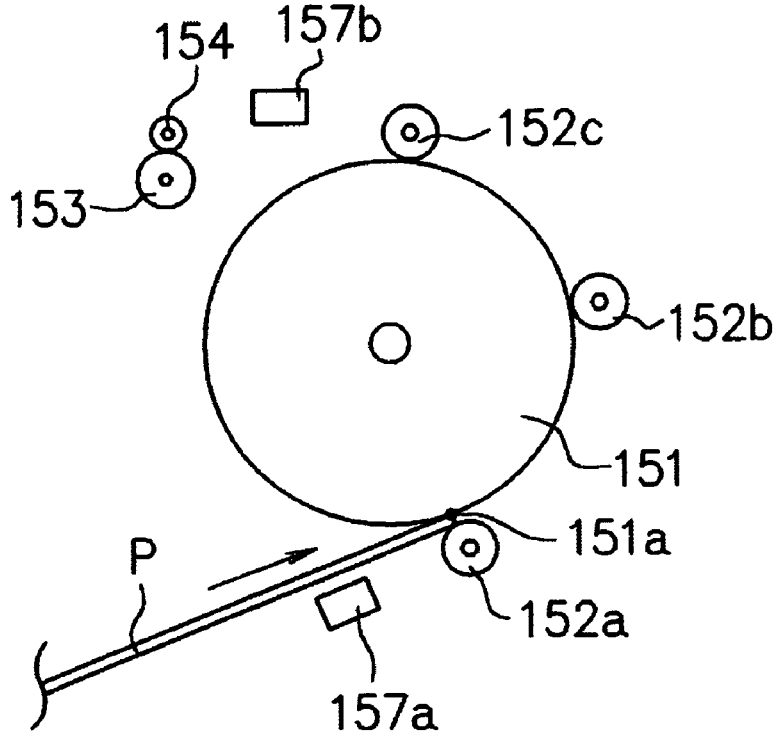
FIGS. 12A and 12B are first views for describing operations of the printer illustrated in FIG. 1.

As illustrated in FIG. 12A, when the cut sheet P being fed arrives at the contact point 151 a between the sub roller 151 and its driven roller 152*a*, the cut sheet P is subjected to elimination of skewing. Various methods are adopted for eliminating skewing, depending on the thickness of the sheet. More specifically, in a case of a cut sheet thinner than a plain sheet, the following method for eliminating skewing is employed: a leading end of the cut sheet is caused to be nipped between the sub roller 151 and its driven roller 152*a* by only a small length, and thereafter the rollers 151 and 152*a* are reversed to thus deflect the cut sheet, thereby aligning the leading end of the cut sheet.

Meanwhile, in a case of a cut sheet thicker than a plain sheet, the following method for eliminating skewing is employed: a leading end of the cut sheet is caused to abut the contact point 151*a* between the sub roller 151 and its driven roller 152*a*, to thus cause the sheetfeed roller 142 to slip, thereby aligning the leading end of the cut sheet. Meanwhile, the length to be bitten and the abutment amount are detected by the detection sensor 157*a*, and elimination of skewing is performed in accordance with the detected values.

The reason for employing different skewing elimination methods for different sheet thicknesses as described above is that: in the case of the thin cut sheet having little stiffness, the sheet feed roller 142 may feed the cut sheet without slipping on the cut sheet; and in the case of the thick cut sheet, the sheet may be exfoliated when the rollers 151 and 152*a* are reversed, since the thick sheet is formed by means of attaching thin cut sheets together.

Figure 12B:
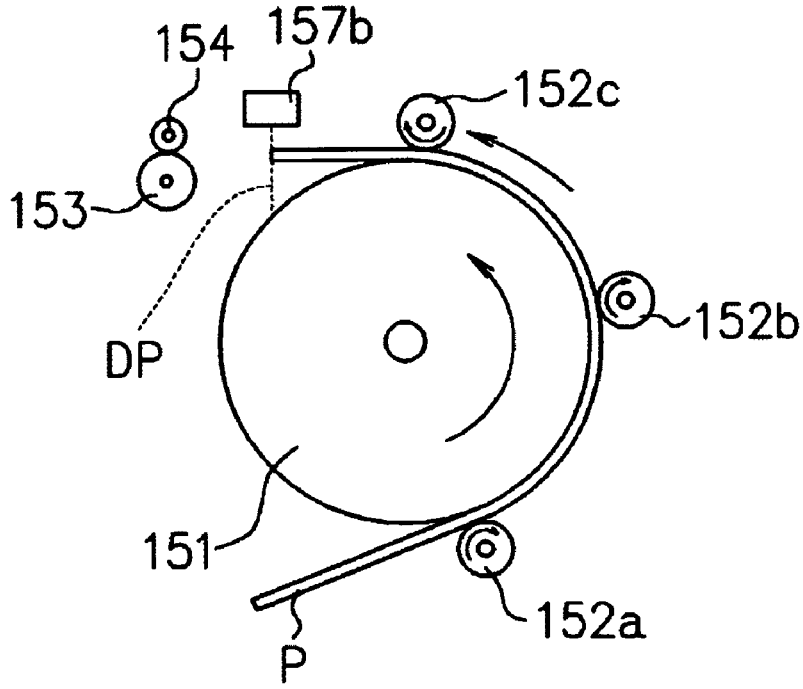

The cut sheet P having been subjected to elimination of skewing is nipped between the sub roller 151 and its driven rollers 152*a*, 152*b*, and 152*c* driven by an unillustrated sheet feed motor, to thus be reversed along the U-shape path; that is, transported in a direction opposite the sheet feeding direction. Then, as illustrated in FIG. 12B, when the leading end of the cut sheet P arrives at a detection point DP of the detection sensor 157*b*, determination of a print-start position; that is, head positioning, of the cut sheet P is performed.

Figure 13A:
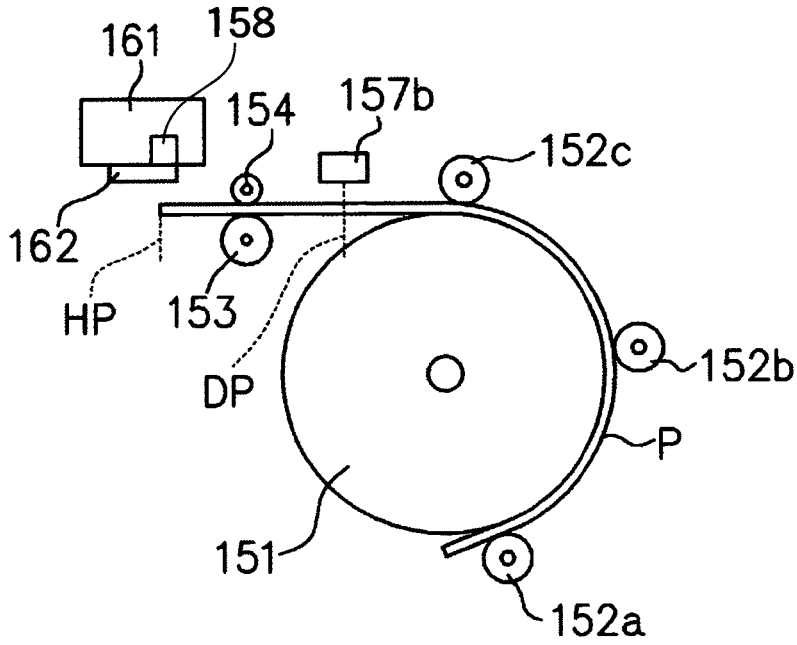
FIGS. 13A and 13B are second views for describing operations of the printer illustrated in FIG. 1.

More specifically, the transportation distance is detected by the detection sensor 157*b* until the leading end of the cut sheet P arrives at a head positioning point HP illustrated in FIG. 13A from the detection point DP passing through between the sheet feed roller 153 and its driven roller 154. Then, the head positioning operation is controlled in accordance with the thus-detected value. Meanwhile, head positioning has conventionally been performed by the detection sensor 157*a* provided upstream of sub roller 151. However, head positioning of the present embodiment is performed by the detection sensor 157*b* provided downstream of the sub roller 151. Accordingly, the distance to be detected can be suppressed to a small value, and an error in head positioning particularly caused by thickness of the sheet can be eliminated, thereby increasing accuracy in head positioning.

Figure 13B:
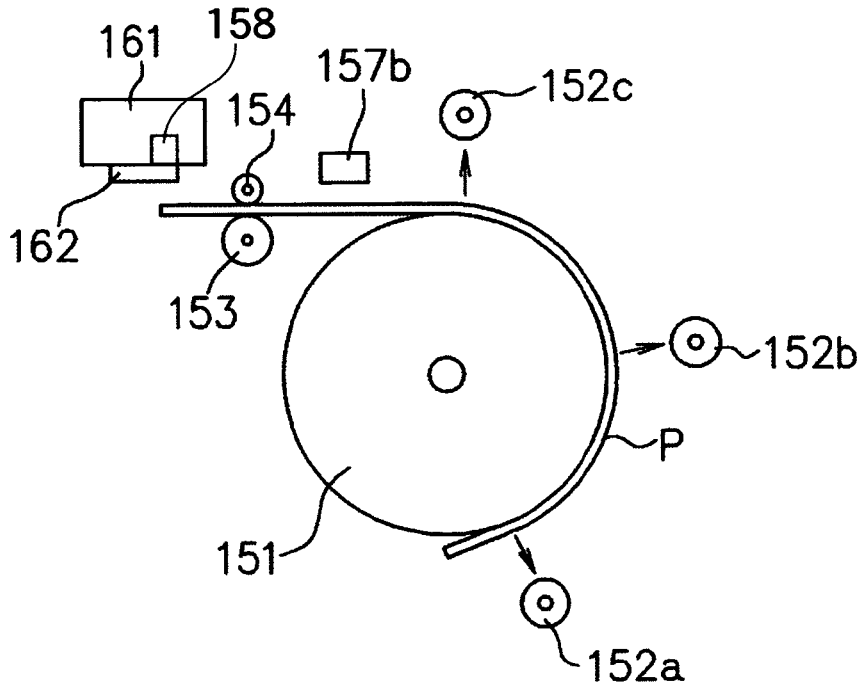

Thereafter, the cut sheet P for which head positioning has been completed is nipped between the sheet feed roller 153 and its driven roller 154 driven by the unillustrated sheet feed motor, to thus be transported to the recording section 160. Hence, since nipping of the cut sheet P between the sub roller 151 and its driven rollers 152*a*, 152*b*, and 152*c* can result in deterioration in transportation accuracy, the respective driven rollers 152*a*, 152*b*, and 152*c* are released from the sub roller 151 as illustrated in FIG. 13B.

The cut sheet P under transportation Is sucked onto the platen 163 by an unillustrated suction fan, thereby being made to be flat, and subjected to printing by the recording head 162 mounted on the carriage 161 which is scanned by an unillustrated carriage motor and a timing belt. At this time, the control section of the inkjet recording apparatus 100 supplies ink of, e.g., seven colors constituted of yellow, dark yellow, magenta, light magenta, cyan, light cyan, and black, to the recording head 162 from ink cartridges of the respective colors. The control section controls ejection timing of ink of each color, and driving of the carriage 161 and the sheet feed roller 153, thereby performing ink dot control with high precision, halftone processing, and the like. Subsequently, the cut sheet P having been subjected to printing is nipped between the sheet output rollers 155 and the spur rollers 156 driven by the unillustrated sheet feed motor, to thus be output to the sheet feed/output section 140, and loaded on the sheet output tray 230 of the sheet output tray 200 in a stacked manner.

As described above, since the recording control method of the invention includes the washing operation for washing ink having been discarded outside the sheet during marginless printing of the sheet in accordance with the predetermined condition, the ink can be prevented from remaining. Since the predetermined condition is a lapse of a predetermined period of time after a start of the marginless recording, the ink can be prevented from being solidified due to time-varying deterioration and remaining. Since the predetermined condition is that the ink level having been discarded within a predetermined period of time in the marginless recording is a predetermined level or lower, the ink can be prevented from remaining because of being too small in amount to flow.

Meanwhile, since the washing operation is performed after the predetermined condition has been satisfied and the recording operation has been performed, the washing operation can be performed in succession to the recording operation, thereby shortening a period of time required for the operations. Since the washing operation is performed outside a recording medium of a maximum size among adaptable recording media, all the remaining ink can be washed away. Meanwhile, since the washing operation is performed outside a sheet of a maximum size among sheets having been subjected to marginless recording performed within the predetermined elapsed time, the amount of ink required for washing can be suppressed small. Since the washing operation is performed on the opposite sides of the sheet, the ink can be caused to flow completely when the ink is caused to flow from one of the sides to the other side. Meanwhile, since the washing operation is performed by means of ejecting an ink which has a tendency not to be viscous among the inks, the ink used for washing does not remain, and can be washed away together with the inks which have a tendency to be viscous.

Meanwhile, since the predetermined condition is that a usage rate of a specific ink is a predetermined usage rate or greater, unnecessary implementation of the washing operation can be prevented, thereby suppressing a cost for consumption of the ink. Since the specific liquid is a ink which has a tendency to be viscous and is easily solidified, adhesion caused by primarily remaining of the ink can be prevented, thereby enabling smooth performance of the washing operation over a long period of time. Meanwhile, the predetermined usage rate is expressed by proportion of an amount of consumption of a specific ink to that of all the inks. Therefore, the predetermined usage rate can be digitized through electrical signal processing with use of, e.g., a detection sensor and a computing unit, thereby enabling reliable control of a determination as to whether or not the washing operation is to be performed.

In the embodiment, an example where ink is employed as the liquid to be washed away has been described. However, any liquid can be employed in the washing operation according to the invention. In the embodiment, an example where an inkjet printer is employed as the recording apparatus has been described. However, any recording apparatus, such as a facsimile or a copying machine, can be employed. In addition, the application is not limited to a recording apparatus, and can be applied to an apparatus provided with a liquid ejection head, and the like. The term "liquid ejection head" referred to here encompasses, e.g., a color-material ejection head employed for manufacture of a color filter, such as a liquid crystal display; an electrode material (conductive paste) ejection head employed for formation of electrodes of an organic EL display, a field emission display (FED), and the like; a bio-organic compound ejection head employed for manufacture of a biochip; and a sample ejection head serving as a precision pipette. There is also provided a program product having that program that can be read out by a predetermined computer or hardware. The program may be recorded on a recording medium. The recording medium is not limited in kind but can be exemplified by all kinds of media such as the CD, the MD or the hard disk.

What is claimed is:

1. A method for controlling recording performed by a recording head operable to eject at least a first liquid and a second liquid, the method comprising:

ejecting the first liquid to a recording medium and a recessed portion situated at an outside of at least one of sides of the recording medium and having a waste liquid passage connecting to a waste liquid tank thereby a recording is performed without a margin at the at least one of the sides of the recording medium;

measuring an amount of the first liquid having been ejected to the recessed portion within a predetermined time period;

ejecting second liquid to the recessed portion to wash away the first liquid in the recessed portion in a case where a predetermined condition is satisfied, wherein the predetermined condition includes a condition in which the amount of the first liquid is no more than a predetermined amount, the first liquid having washed away is let to the waste liquid tank, the second liquid has a greater tendency not to be viscous than the first liquid, and the first and second liquid are colored ink.

2. The method according to claim 1, further comprising measuring a time period having elapsed since processing for executing the recording is started, wherein the predetermined condition includes a condition in which the time period is equal to a predetermined time period.

3. The method according to claim 2, wherein the second liquid is ejected to a recessed portion that is situated at the outside of at least one of sides of a largest recording medium used in the predetermined time period.

4. The method according to claim 1, wherein the second liquid is ejected after processing for executing the recording is finished.

5. The method according to claim 1, wherein the recording medium includes a first recording medium, and a second recording medium having a larger size than the first recoding medium, and the second liquid is ejected to a recessed portion that is situated at the outside of at least one of sides of the second recording medium.

6. The method according to claim 1, wherein the second liquid is ejected to recessed portions that are situated at opposite sides of the recording medium.

7. The method according to claim 1, wherein the first liquid includes a first type of liquid and a second type of liquid, and the predetermined condition includes a condition in which an usage rate of the first type of liquid is no less than a predetermined usage rate.

8. The method according to claim 7, wherein the first type of liquid has tendency to be viscous.

9. The method according to claim 7, wherein the predetermined usage rate is proportion of an amount of consumption of the first type of liquid to an amount of consumption of the first liquid.

10. A computer program stored on a computer readable storage medium for controlling recording performed by a recording head operable to eject at least a first liquid and a second liquid, the computer program executing the steps of:

ejecting the first liquid to a recording medium and a recessed portion situated at an outside of at least one of sides of the recording medium and having a waste liquid passage connecting to a waste liquid tank thereby a recording is performed without a margin at the at least one of the sides of the recording medium;

measuring an amount of the first liquid having been ejected to the recessed portion within a predetermined time period;

ejecting second liquid to the recessed portion to wash away the first liquid in the recessed portion in a case where a predetermined condition is satisfied, wherein the predetermined condition includes a condition in which the amount of the first liquid is no more than a predetermined amount, the first liquid having washed away is let to the waste liquid tank, the second liquid has a greater tendency not to be viscous than the first liquid, and the first and second liquid are colored ink.

11. A liquid ejecting apparatus operable to execute the method comprising the steps of:

ejecting the first liquid to a recording medium and a recessed portion situated at an outside of at least one of sides of the recording medium and having a waste liquid passage connecting to a waste liquid tank thereby a recording is performed without a margin at the at least one of the sides of the recording medium;

measuring an amount of the first liquid having been ejected to the recessed portion within a predetermined time period;

ejecting second liquid to the recessed portion to wash away the first liquid in the recessed portion in a case where a predetermined condition is satisfied, wherein the predetermined condition includes a condition in which the amount of the first liquid is no more than a predetermined amount, the first liquid having washed away is let to the waste liquid tank, the second liquid has a greater tendency not to be viscous than the first liquid, and the first and second liquid are colored ink.

* * * * *